United States Patent [19]

Baguelin

[11] 3,976,042

[45]*Aug. 24, 1976

[54] MULTICYLINDER INTERNAL COMBUSTION ENGINE OF THE DIESEL TYPE

[75] Inventor: Yves Baguelin, Louveciennes, France

[73] Assignee: Societe Anonyme de Vehicules Industriels et d'Equipements Mecaniques SAVIEM, Suresnes, France

[ * ] Notice: The portion of the term of this patent subsequent to Sept. 2, 1992, has been disclaimed.

[22] Filed: Oct. 8, 1974

[21] Appl. No.: 513,270

Related U.S. Application Data

[63] Continuation-in-part of Ser. No. 362,837, May 22, 1973, Pat. No. 3,902,472.

[30] Foreign Application Priority Data

Nov. 14, 1973 France ..... 73.40552

[52] U.S. Cl. ..... 123/139 AR; 123/139 ST; 123/139 BD; 123/179 G

[51] Int. Cl.[2] ..... F02M 39/00

[58] Field of Search..... 123/198 F, 179 G, 179 E, 123/179 L, 139 AA, 139 ST, 139 AC, 139 AR, 139 AZ, 52 M, 139 BD; 60/698, 706, 716, 717

[56] References Cited

UNITED STATES PATENTS

| | | | |
|---|---|---|---|
| 2,126,483 | 8/1938 | L'Orange | 123/139 AA |
| 2,771,867 | 12/1956 | Peras | 123/198 F |
| 2,875,742 | 3/1959 | Dolza | 123/198 F |
| 3,741,685 | 6/1973 | Simko | 123/198 F |

*Primary Examiner*—Charles J. Myhre
*Assistant Examiner*—James D. Liles
*Attorney, Agent, or Firm*—Lewis H. Eslinger

[57] ABSTRACT

A Diesel engine comprises a set of starting cylinders and a set of power cylinders; and an injection pump including two sets of plunger pistons, one said set of plunger pistons being associated with the starting cylinders for supplying fuel to the starting cylinders and the other set of plunger pistons being associated with the power cylinders for supplying fuel to the power cylinders. Emission of unburned hydrocarbons and nitrogen oxides is reduced as compared with conventional Diesel engines.

3 Claims, 5 Drawing Figures

MULTICYLINDER INTERNAL COMBUSTION ENGINE OF THE DIESEL TYPE

This application is a continuation-in-part of U.S. patent application Ser. No. 362,837 filed May 22, 1973 and now U.S. Pat. No. 3,902,472.

The present invention relates to multicylinder internal combustion engines of the Diesel type.

U.S. patent application Ser. No. 362,837 relates to a Diesel engine comprising a set of starting cylinders and a set of power cylinders, means associated with the power cylinders, which means make the starting cylinders more suitable for starting the engine than the power cylinders, and means associated with the power cylinders, which means make the power cylinders more suitable for running the engine under full power than the starting cylinders.

According to the aforementioned patent application, the power cylinders may differ from the starting cylinders in their compression ratios, their inlet valve closure settings or their associated fuel injection devices. The fuel injection devices associated with the power cylinders may differ from those associated with the starting cylinders as to their advance and the rate of fuel delivery for a particular engine load.

An object of the present invention is to provide a Diesel engine having a set of starting cylinders and a set of power cylinders in which the rate of delivery of fuel to the two sets of cylinders is controlled under different engine operating conditions, such as operation at less than full load, during idling and during starting so that pollution, in particular the amount of unburnt hydrocarbons emitted by the engine is reduced as compared with the engine of the aforementioned patent application.

In the aforementioned patent application, the number of starting cylinders is less than the number of power cylinders and the starting cylinders may have a higher compression ratio than the power cylinders for facilitating starting of the engine. In the present invention, the starting cylinders are exploited in preferential manner for the starting action and the low rates of injected flow in order to ensure a more complete combustion and the power cylinders having a low compression ratio are exploited as soon as the load is substantial and, in principle, are intended to receive higher rates of injected flow with reduced maximum cycle pressures, which causes a lesser generation of nitrogen oxides (NOx).

In accordance with the present invention, the injection pump comprises two sets of plunger pistons, one said set being for supplying the starting cylinders and the other set being, for supplying the power cylinders.

Preferably the injection pistons of the pump which are entrained in rotation by a common rack, have two kinds of injection cams which are organised in each case to provide two concomitant injection principles appropriate for the two sets of cylinders.

The invention is further described below with reference to the accompanying drawings, wherein.

Figure 3A:
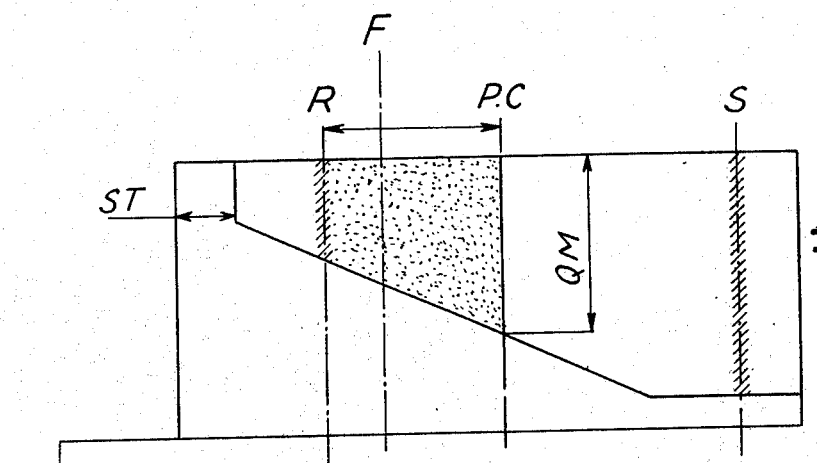
Figure 3B:
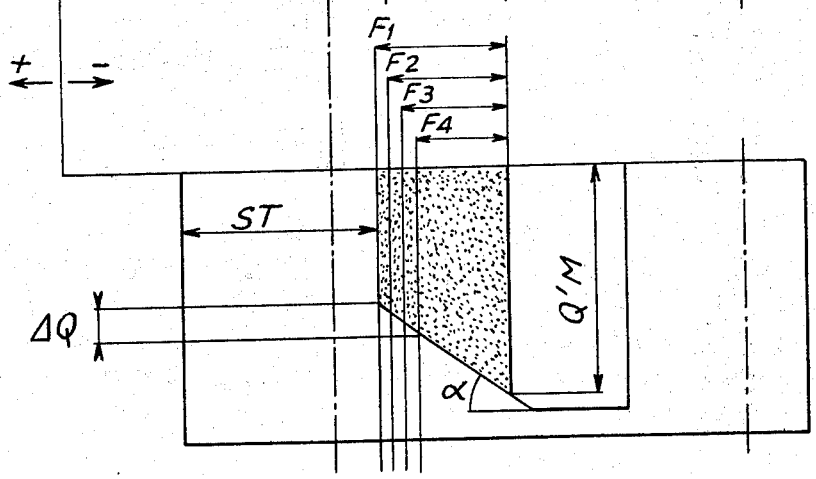
Figure 4:
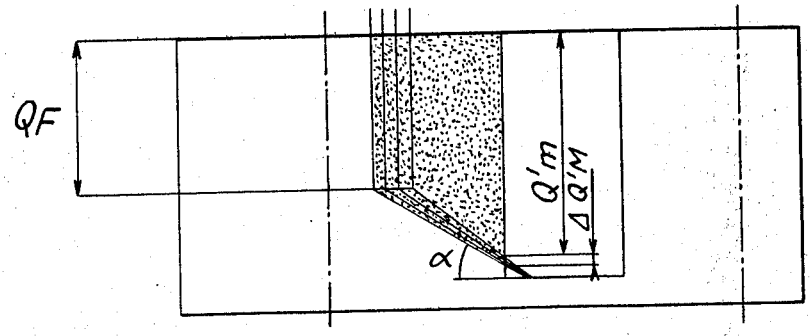

FIG. 3*a* and 3*b* are developed views of the cam of the two sets of piston of the pump, and FIG. 4 is a view of a modified form of the piston cam contour of FIG. 3*b*.

Figure 1:
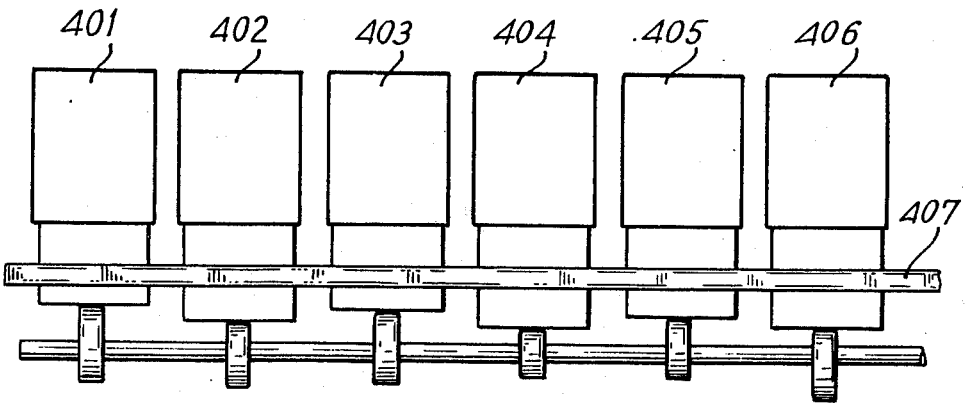
FIG. 1 is a diagrammatic view illustrating the pistons of an injection pump of a Diesel engine in accordance with the invention.

Referring to FIG. 1, a Diesel engine comprises a set of starting cylinders and a set of power cylinders. The engine also comprises an injection pump in which pistons 401 and 402 are for supplying the starting cylinders of the engine and pistons 403 to 406 are for supplying the power cylinders.

The pistons 401 to 406 are organised, in each case, to provide two rules governing concomitant injection appropriate for the two sets of cylinders of the engine and they are engaged with and rotatable by a common rack 407, the position of which depends upon the engine load.

Figure 2:
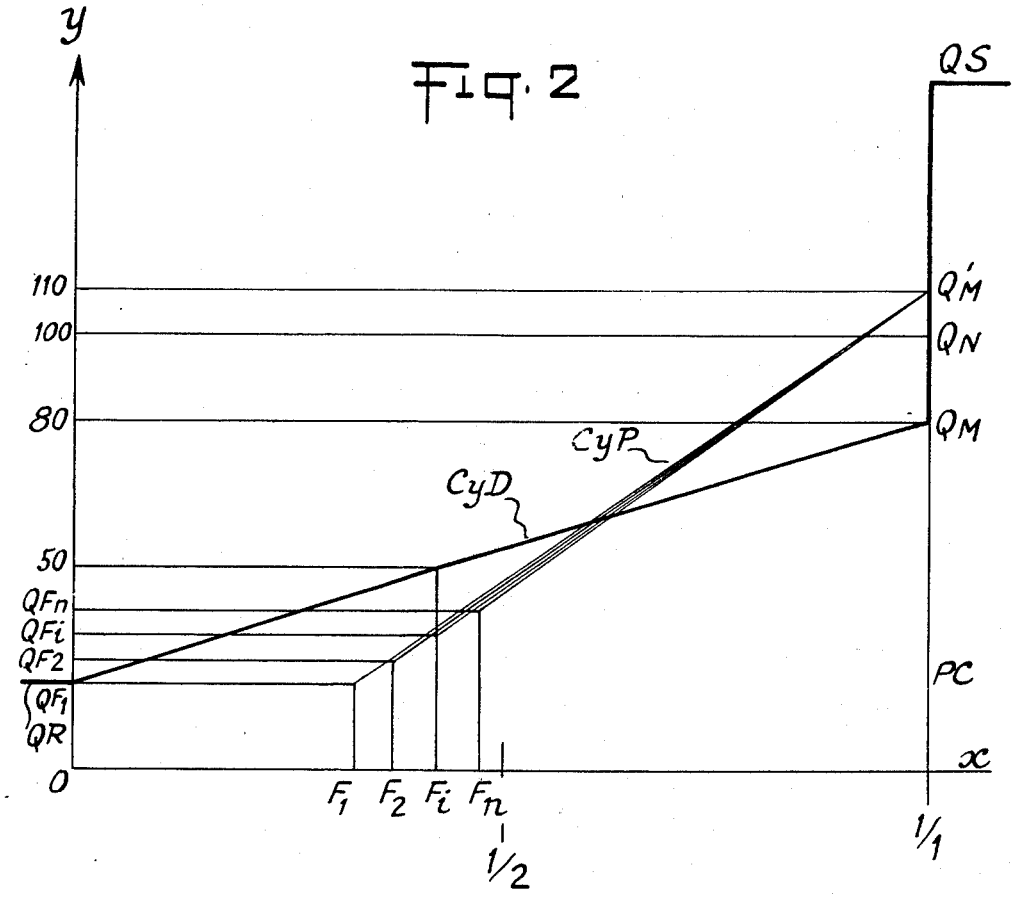
FIG. 2 is a diagram of the rules governing injection, corresponding to the two sets of pistons of the pump.

Referring to FIG. 2 the engine load has been plotted along the abscissa OX and the rate of flow has been plotted along the ordinate OY. The position of the rack 407 corresponds to the engine load. In FIG. 2, the figure 100 on the abscissa represents the rate of flow QN of maximum injection of a conventional engine having identical cylinders adjusted in such manner as to obtain a compromise between ease of starting, maximum cycle pressure and emission of unburned hydrocarbon and nitrogen oxide.

In FIG. 2, a thick line CyD represents the injection rule (i.e. the rate of fuel flow at any given engine load) for the starting cylinders, and fine lines CyP represent the injection rule for the power cylinders. It can be seen that there are slight differences between the lines CyP except at full engine load, the differences decreasing as engine load decreases.

As apparent from FIG. 2, the rates of flow for overload QS, for idling speed QR and for low load from O to approximately one-third of the stroke of the rack 407, are present only on the trace CyD corresponding to the starting cylinders. These rates of flow are zero on the line CyP.

The normal operational rate of flow for the starting cylinders CyD varies linearly as a function of the displacement of the rack from QR to a maximum value QM lower than QN, which represents the normal rate of flow for a conventional engine. The rate of flow QM may be 20% lower than the rate of flow QN.

The normal operational rate of flow depicted by the lines CyP for the power cylinders comes into effect only when the starting cylinders have gone beyond one-fourth or rather up to one-half load, and this rate of flow rapidly acquires the value QFi corresponding to a fraction of the mean load of between 25 and 50%.

The power cylinders CyP assume their load QFi consecutively in such manner as to reduce the discontinuity of the engine torque developed as a function of the advance of the rack, and the rates of flow QF1, QF2, QFi and QFn are obtained consecutively.

By linear variation from the initial rate of flow QFi, the maximum rate of flow for the power cylinders CyP reaches a maximum value Q'M exceeding QN by approximately 10%, for example.

The consequence of this conjugated operation of the two sets of cylinders affected by different and complementary simultaneous injection rules is that the case of operation when cold (starting, warming up) or with weak fuel mixture (idling, partial load) is established by means of the starting cylinders having a high compression ratio, with a consequent reduction of the amount of unburned hydrocarbons emitted.

By contrast, the cylinders having a low compression ratio are those which bear the high loads with substantial fuel injection volumes, determined by the limitation of the maximum cycle pressure and the generation of nitrogen oxides based on the lower compression.

FIG. 3*a* illustrates a developed view of the cam, i.e. injection profile, of one of the pistons of the injection pump, 401 or 402, which is for supplying fuel to a starting cylinder, and FIG. 3*b* illustrates a developed view of the cam of one of the injection pistons 403 to 406 for supplying fuel to a power cylinder.

In FIGS. 3*a* and 3*b*, each of the vertical lines illustrates a position corresponding to the operation of the engine. The vertical line R corresponds to idling speed operation, the line F corresponds to a low load operation, the line PC corresponds to full load operation, the line S corresponds to overload operation.

In each of FIGS. 3*a* and 3*b*, the amount of fuel injected per cycle of the plunger is proportional to the effective delivery stroke length which is equal to the length of the vertical line within the stipled area.

Only the starting pistons 401, 402 (FIG. 3*a*) serve to supply fuel at idling speed and at low load operation corresponding to any vertical line from R to F. The power pistons 403 to 406 supply the cylinders (FIG. 3*b*) when the engine operation corresponds to any vertical line from F to PC. Q'M exceeds QM at the position PC corresponding to full engine load. Only the pistons 401 and 402 (FIG. 3*b*) serve to supply the starting cylinders for overload operation of the engine corresponding to the vertical line S.

The consecutive activations of several power cylinders whereof the initial rates of flow differ by $\Delta$ Q, if the same cam angle $\alpha$ and the same nominal rate of flow Q'M are retained, are depicted at $F_1$, $F_2$, $F_3$, $F_4$ in FIG. 3*b*. The part of ST of the pistons corresponds to no supply of fuel.

FIG. 4 illustrates a modified form of the injection piston illustrated in FIG. 3*b*. The piston of FIG. 4 provides the same initial rate of flow QF by varying the cam angle $\alpha$, but there is a small variation $\Delta$ Q'M of the nominal rate of flow Q'M if it is wished to retain the possibility of adjustment.

Generally speaking, the differentiation between the rates of injection flow may be applied to a multicylinder engine comprising identical cylinders, in order to increase the degree of exploitation of the cylinders under heavy load for antipollution purposes.

In view of the predominant influence of the compression ratio in combination with the richness of the mixture charge, the results are more decisive in the case of selective compression which, moreover, improves ease of starting.

I claim:

1. A diesel engine comprising: a set of starting cylinders and a set of power cylinders; an injection pump including two sets of plunger pistons, one said set of plunger pistons being associated with the starting cylinders for supplying fuel to the starting cylinders and the other set of plunger pistons being associated with the power cylinders for supplying fuel to the power cylinders; and common rack means for engaging and rotating said plunger pistons; the pistons of said one set of the injection pump each having an injection profile appropriate for supplying fuel to the starting cylinders for starting the engine and the pistons of said other set of the injection pump each having an injection profile appropriate for supplying fuel to the power cylinders for normal to full load operation of the engine.

2. A diesel engine as claimed in claim 1, wherein the pistons of said one set but not the pistons of said other set of the injection pump serve to supply fuel to the cylinders during idling operation, low load operation and overload operation of the engine.

3. A diesel engine as claimed in claim 1, wherein the compression ratio of the starting cylinders is greater than the compression ratio of the power cylinders.

* * * * *